US008550317B2

(12) United States Patent
Hyseni

(10) Patent No.: US 8,550,317 B2
(45) Date of Patent: Oct. 8, 2013

(54) ELECTRONIC DEVICE CASE GRIPPER

(75) Inventor: Ervis Hyseni, Ontario (CA)

(73) Assignee: Ervis Hyseni, Ontario (CA)

( * ) Notice: Subject to any disclaimer, the term of this patent is extended or adjusted under 35 U.S.C. 154(b) by 224 days.

(21) Appl. No.: 13/221,267

(22) Filed: Aug. 30, 2011

(65) Prior Publication Data

US 2012/0048873 A1 Mar. 1, 2012

(30) Foreign Application Priority Data

Aug. 31, 2010 (CA) ..... 2714130

(51) Int. Cl.
*A45F 5/00* (2006.01)

(52) U.S. Cl.
USPC ..... 224/197; 224/217; 224/218; 224/930

(58) Field of Classification Search
USPC ..... 224/197, 217, 218, 930, 255, 578; 361/679.59; 455/575.6; 379/449; 150/108, 110; 16/425, 427; 220/752, 220/754, 757, 763, 770, 775, 776
See application file for complete search history.

(56) References Cited

U.S. PATENT DOCUMENTS

| | | | | |
|---|---|---|---|---|
| 4,763,763 | A * | 8/1988 | Sadow | 190/115 |
| 5,111,952 | A * | 5/1992 | Stocchiero | 220/754 |
| 7,661,567 | B2 * | 2/2010 | Myers | 224/217 |
| 8,374,657 | B2 * | 2/2013 | Interdonato | 455/575.4 |
| 8,405,981 | B2 * | 3/2013 | Takemasa et al. | 361/679.59 |
| 8,428,664 | B1 * | 4/2013 | Wyers | 455/575.1 |
| 2005/0205623 | A1 * | 9/2005 | Buntain | 224/217 |
| 2006/0180621 | A1 * | 8/2006 | Ladouceur | 224/269 |
| 2009/0270050 | A1 * | 10/2009 | Brown | 455/90.3 |
| 2011/0084081 | A1 * | 4/2011 | Chung et al. | 220/628 |
| 2011/0266316 | A1 * | 11/2011 | Ghalib et al. | 224/217 |
| 2011/0279959 | A1 * | 11/2011 | Lopez | 361/679.03 |
| 2011/0309117 | A1 * | 12/2011 | Roberts | 224/217 |
| 2012/0025684 | A1 * | 2/2012 | Trotsky | 312/334.1 |
| 2012/0042476 | A1 * | 2/2012 | Karmatz | 16/421 |
| 2012/0104185 | A1 * | 5/2012 | Carroll | 248/27.1 |
| 2012/0111881 | A1 * | 5/2012 | Gaddis et al. | 220/752 |
| 2012/0228346 | A1 * | 9/2012 | Huang | 224/218 |
| 2013/0119099 | A1 * | 5/2013 | Interdonato | 224/217 |

* cited by examiner

*Primary Examiner* — Justin Larson
(74) *Attorney, Agent, or Firm* — Eschweiler & Associates, LLC

(57) ABSTRACT

In one preferred embodiment, the present invention is a gripper for gripping a portable electronic device case. The case has a defined opening, and an inside and outside. The gripper comprises a retainer to partially pass through the case opening, and the retainer defines two opposing slots. There is a retractable strap having two flanged ends. Each strap flanged end is passed through the retainer slots to communicate with the case inside. The strap flange is shaped to prevent the strap from completely passing through said retainer slots to the case outside when the strap is pulled. The gripper facilitates carrying a portable electronic device using a single finger, or an open hand, depending on the size of the device.

16 Claims, 7 Drawing Sheets

ELECTRONIC DEVICE CASE GRIPPER

RELATED APPLICATION

This application claims priority to Canadian patent application No. 2,714,130, filed on Aug. 31, 2010, entitled "Electronic Device Case Gripper" which is herby incorporated by reference in its entirety.

FIELD

This invention relates to electronic device cases, and more specifically, grippers for portable electronic device cases to facilitate carrying and handling of said case.

BACKGROUND

Numerous portable electronic devices are well known, a most basic of these being modern cellular telephones. Recent advancements in wireless communication technologies have spawned newer generation hybrid computer phones, such as Blackberry™ and iPhone™. These modern hybrid computer phones, and modern cellular telephones generally, tend to be relatively flat and are sometimes marketed as being "slim". There is also now a market push for relatively flat computers, such as the iPad™. What these telephones, computer phones, and computers share in common is that they can be generically referred to as portable electronic devices.

There is also a market push for carrying cases for these portable electronic devices. These cases tend to be both inwardly and outwardly shaped similar to the device they are meant to carry, and are often made of a hard plastic. These cases are typically for protection against damage when the device is accidentally dropped. These cases also often come with a detachable holster, to holster the case and device to pants, belts, purses, and the like. When detached from its holster, these cases are carried in hand, and subject to accidental dropping. For larger computers and computerized tablets (like an iPad™), a holster device is impractical and the computer (and its case) are typically carried under-arm. When so carried or handled, these devices are prone to be dropped and damaged.

Another market trend in these portable devices is that they now offer screen displays and keyboards that can alternate between a relatively vertical and relatively horizontal configuration. For example, a modern cellular telephone might be held vertically upright in a traditional position where a user can dial a phone number (using a standard numeric keyboard arrangement), and thereafter be moved into a horizontal position to type a text message (using a standard "qwerty" keyboard). "Smart" technology enables devices such as the iPhone™ to automatically reposition its display screen once a user shifts the phone from a vertical to a horizontal position (or vice-versa). These shifts require the user moving his hand from one position to another, and sometimes results in grip loss, with the device and case subsequently falling to the ground.

SUMMARY

In one preferred embodiment, the present invention is a gripper for gripping a portable electronic device case. The case has a defined opening, and an inside and outside. The gripper comprises a retainer to partially pass through the case opening, and the retainer defines two opposing slots. There is a retractable strap having two flanged ends. Each strap flanged end is passed through the retainer slots to communicate with the case inside. The strap flange is shaped to prevent the strap from completely passing through said retainer slots to the case outside when the strap is pulled.

DETAILED DESCRIPTION

Figure 3:
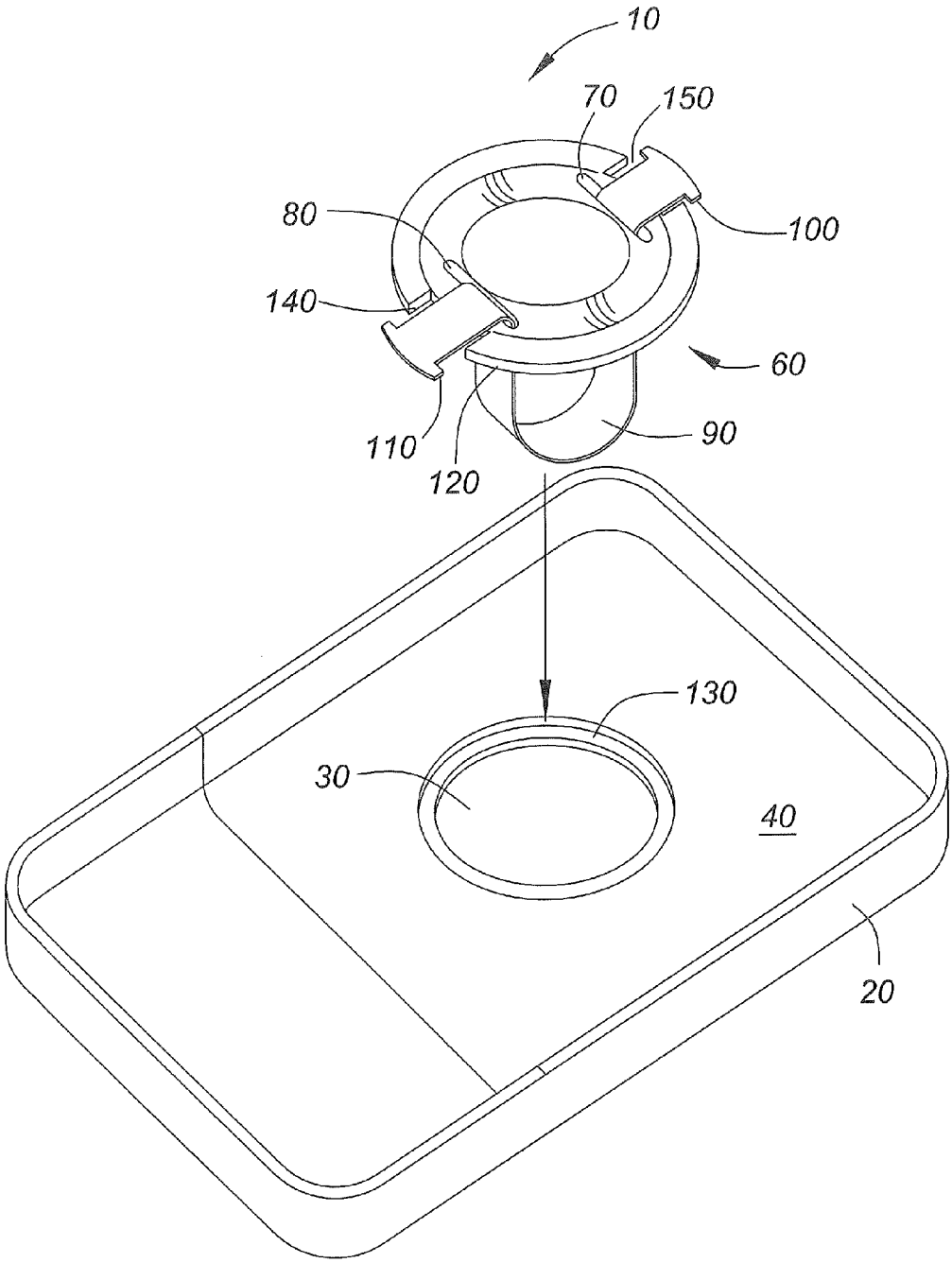
FIG. 3 is an exploded bottom side view of the gripper and portable electronic device case.

FIG. 3. shows a gripper (10) generally, for gripping a portable electronic device case (20), in an exploded view. The case (20) defines an opening (30), an inside (40) and an outside (50). The case (20) is sized and dimensioned to receive a portable electronic device, be it a phone, a computer, a hybrid computer-phone, or any portable electronic device one wishes to carry. The case (20) is often made of a plastic, but any material is suitable so long as the case (20) functions to carry the portable device of choice. Cases (20) are available in leather and other fabrics, and the present gripper (10) works, or should work, with any case (20) material or fabric, provided such case (20) is suitably constructed to receive said gripper (10) and allow proper functioning of same.

Figure 5:
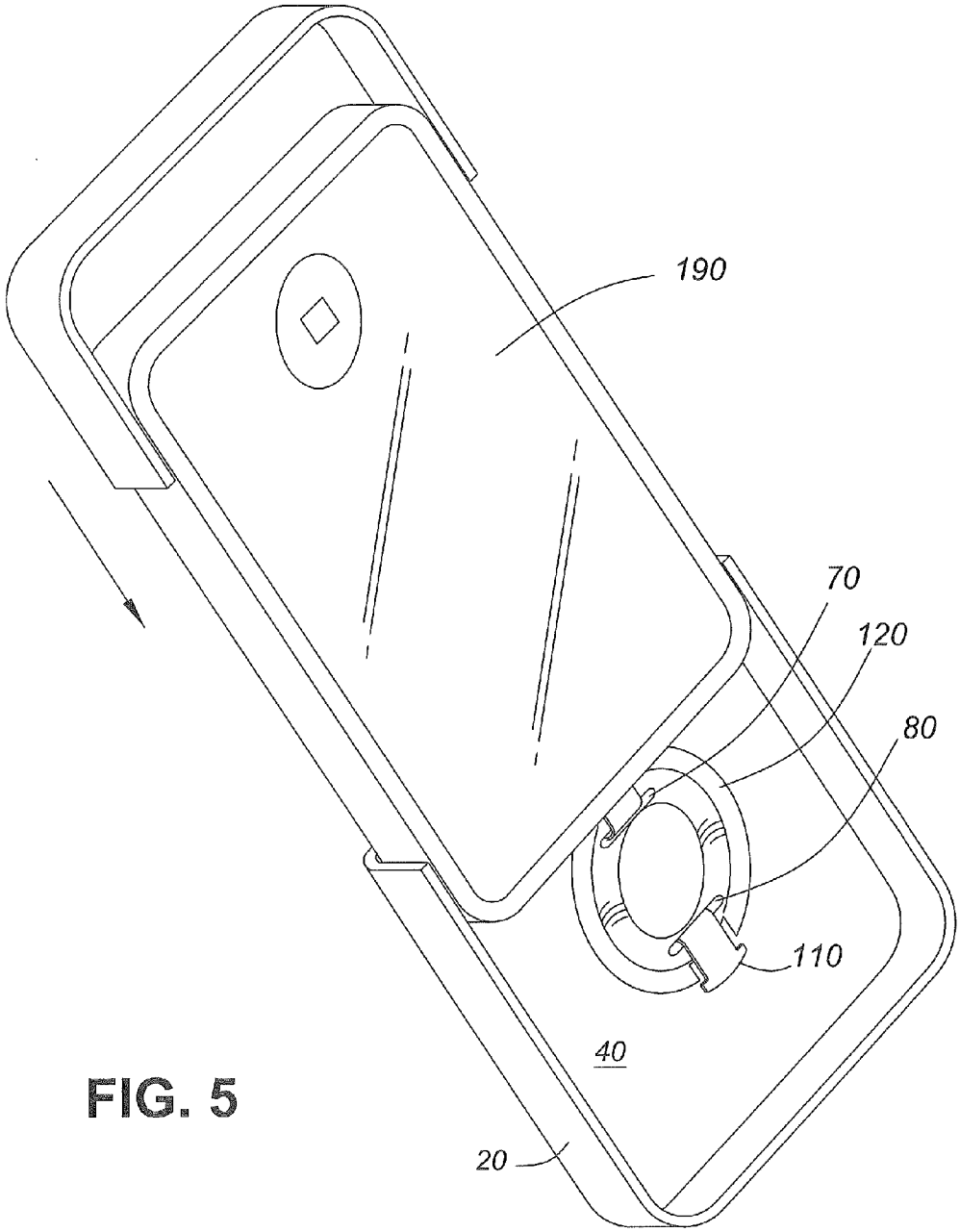
FIG. 5 is a partly exploded bottom side view of the gripper and portable electronic device case, with a smart phone inserted into the device case.
Figure 6:
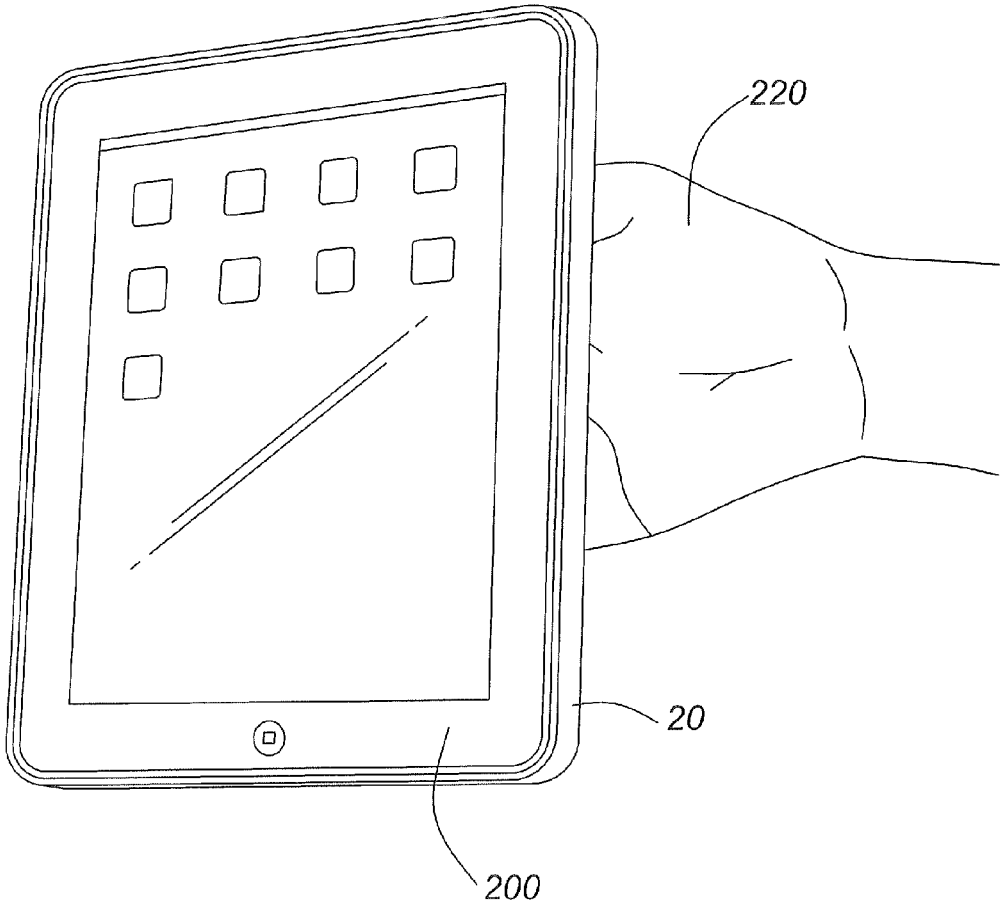
FIG. 6 is a perspective view of a tablet computer fitted into a portable electronic device case, operated by a hand.
Figure 7:
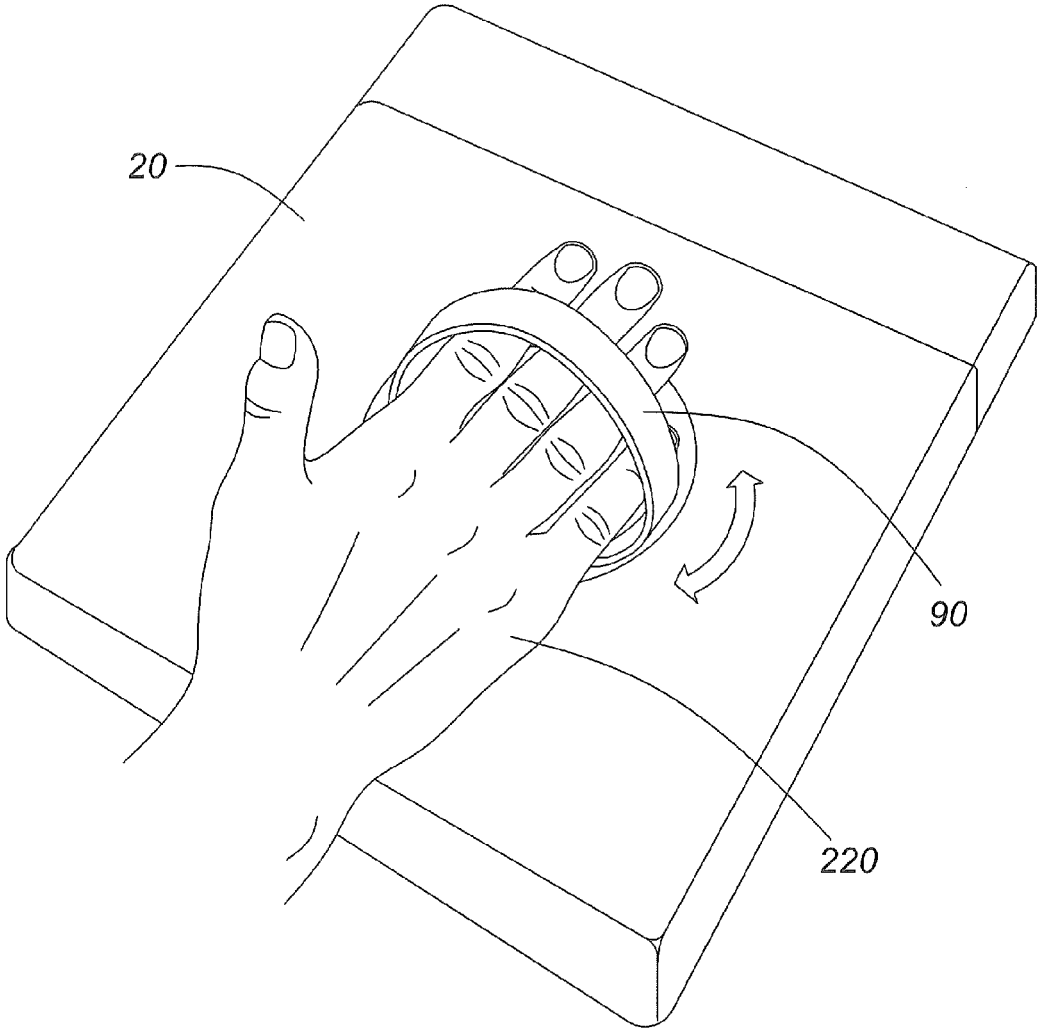
FIG. 7 is a perspective view of a gripper provided in a portable electronic device case, with its strap in a pulled position, and operated by a hand.

The gripper (10) is comprised of a retainer (60), and can be made of any suitable material including plastic. The gripper (10) can also be sized accordingly, depending on whether it is designed for a case (20) to carry a phone (190), a tablet computer (200), or any other device. In a preferred embodiment, the retainer (60) is circular, matching in shape to the case opening (30). More particularly, the retainer (60) is shaped such that it can only partially pass through the case opening (30). In this specific example, the partial-passing is accomplished by how the retainer (60) is shaped in comparison to the case opening (30). Although both the opening (30) and retainer (60) are circular, the opening provides a step (130, see FIG. 2A) therein, and the retainer (60) likewise defines a step (120) to form a two-level disc. In the preferred embodiment shown, both the opening step (130) and retainer step (120) circumscribe the opening (30) and retainer (60) respectively (ie the opening step (130) is a recessed groove circumscribing the case opening (30); the retainer step (120) is a flange circumscribing the retainer (60)). The opening step (130) and retainer step (120), when assembled, mate (FIG, 2A) (ie the circumscribing flange biases against the recessed groove so that the retainer (60) cannot freely pass through the case opening (30) from the case inside (40) to the case outside (50)). One advantage of a mated fit is that smart phones (190) (FIG. 5) and computer tablets (200) (FIG. 6) alike properly fit into their respective cases (20), without interfering with the gripper's (10) operation. In other words, the mating of the retainer (60) with the case (20) result in the retainer (60) lying flat and in a plane with the case inside (40) (the circumscribing flange nestles with the recessed groove). FIG. 5 demonstrates how, once the retainer (60) lies flat and planar with the case inside (40), any portable electronic device like a smart phone (190) can slide easily into the case (20), without any obstruction.

Figure 4:
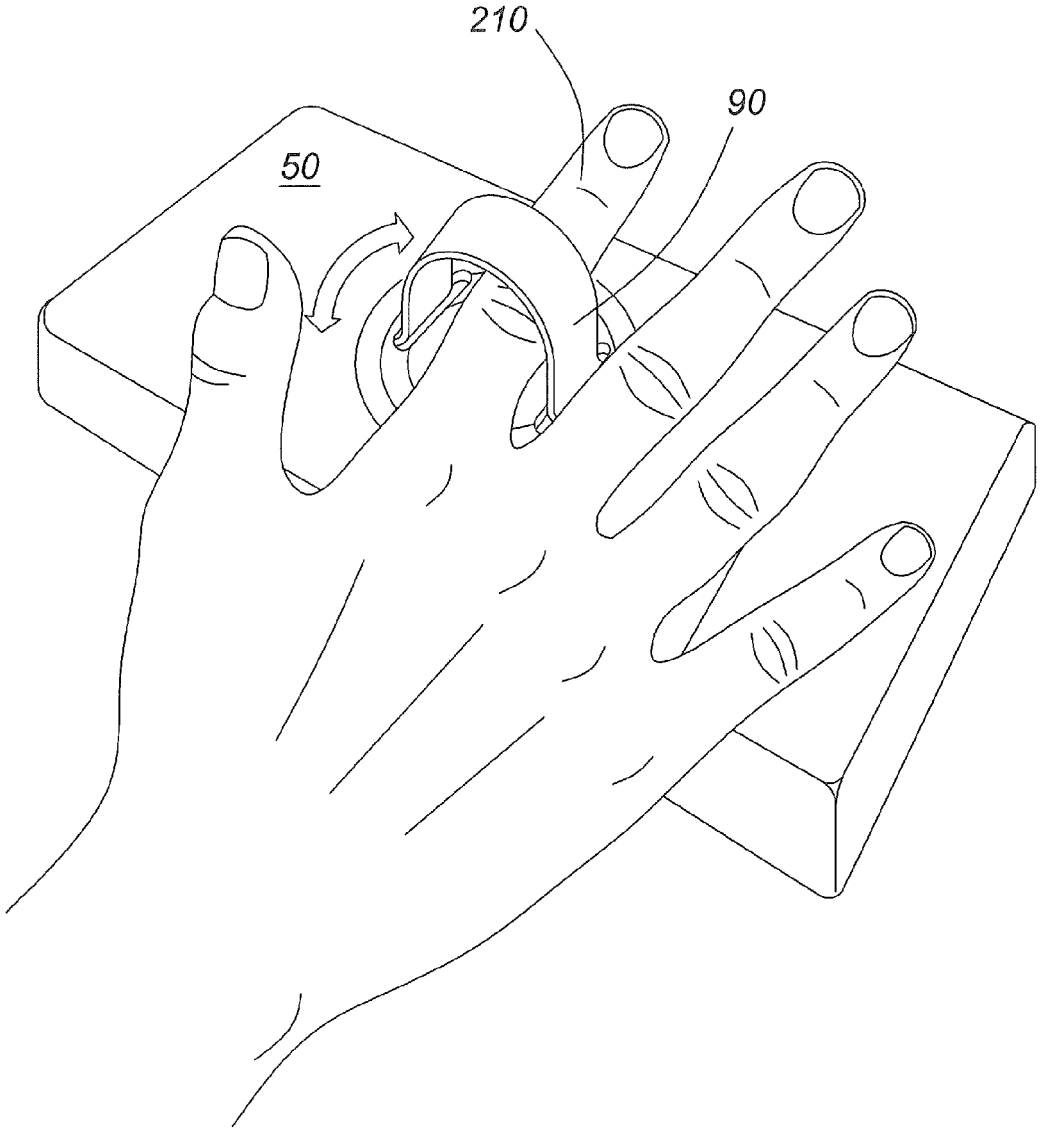
FIG. 4 is a perspective topside view of the gripper provided in a portable electronic device case, with its strap in a pulled position, and operated by a finger.

Although the retainer (60) and opening (30) are mated, they are preferably not rigidly fixed to each other, and the gripper (10), when operated by a finger (210) or hand (220) (as appropriate), can freely rotate (see FIG. 4) such that the case (20) can be orientated relatively horizontally or vertically. Modern smart phones (190) and computer tablets (200) automatically reorient text and images from relatively horizontal to relatively vertical orientations (and back again) once the phone (190) or tablet (200) is moved from a relatively horizontal to a relatively vertical position, and vice-versa.

The gripper (10) defines two opposing slots (70, 80), which in the preferred embodiment shown (FIG. 3), are oblong. The slots (70, 80) can be any shape, so long as a strap (90) can pass therethrough. The opposing slots (70, 80) are adjacent the retainer step (120) (circumscribing flange). The slot (70, 80) locations and positions can vary, so long as they ultimately do not interfere with operation of the strap (90).

Figure 2:
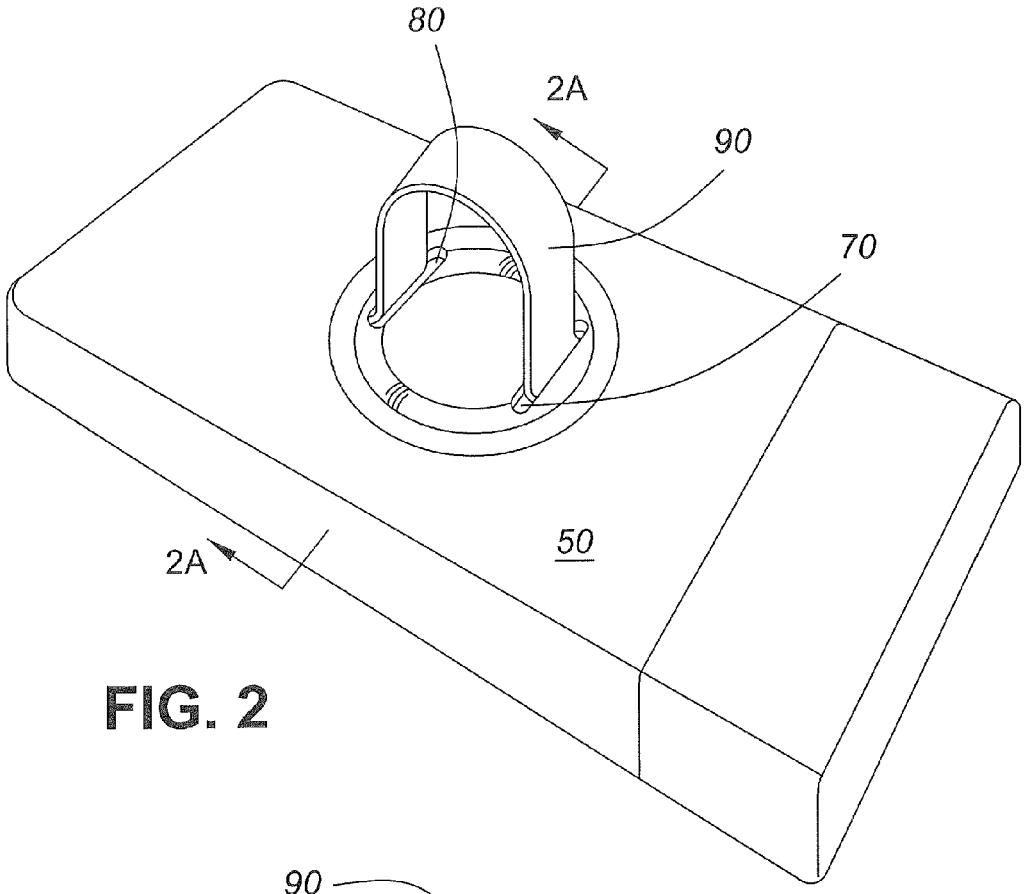
FIG. 2 is a perspective topside view of the gripper provided in a portable electronic device case, with its strap in a pulled position.
Figure 2A:
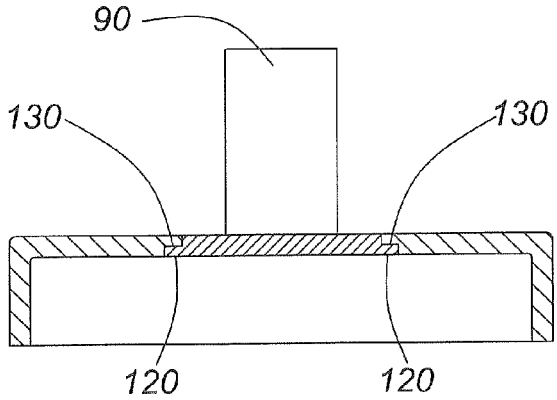
FIG. 2A is a cross-section along the lines 2A in FIG. 2.

The (preferably retractable) strap (90) has two flanged ends (100, 110), and can be made of a fabric, a flexible thin plastic, or other suitable material. The strap (90) can be sized to permit a finger or a hand to pass therethrough, when the strap is in its pulled position (FIG. 2). The strap (90) facilitates rotation of the gripper (10) (discussed above). Ideally the strap (90) flanged ends (100, 110) are shaped such that they do not easily pass through the opposing slots (70, 80) when the strap (90) is in a pulled position (FIG. 2). That is, the flanged ends (100, 110) would require manipulation in order to insert them through the slots (70, 80) and once therethrough, would not easily pass back out without further specific manipulation. Once the strap ends (100, 110) are passed through the retainer slots (70, 80), they communicate with the case inside (40).

To better ensure the strap (90) does not easily pass back out the slots (70, 80) to the case outside (50), the retainer step (180) (circumscribing flange) can define two opposing breaks (140, 150) therein. The strap flanged ends (100, 110) can be shaped such that they can initially be placed beyond the retainer breaks (140, 150) but cannot be easily pulled back there through. That is, the breaks (140, 150) can be dimensioned to be smaller than the flanged ends (100, 110), to resist (ie bias against) the strap ends (100, 110) when the strap (90) is in a pulled position.

Figure 1:
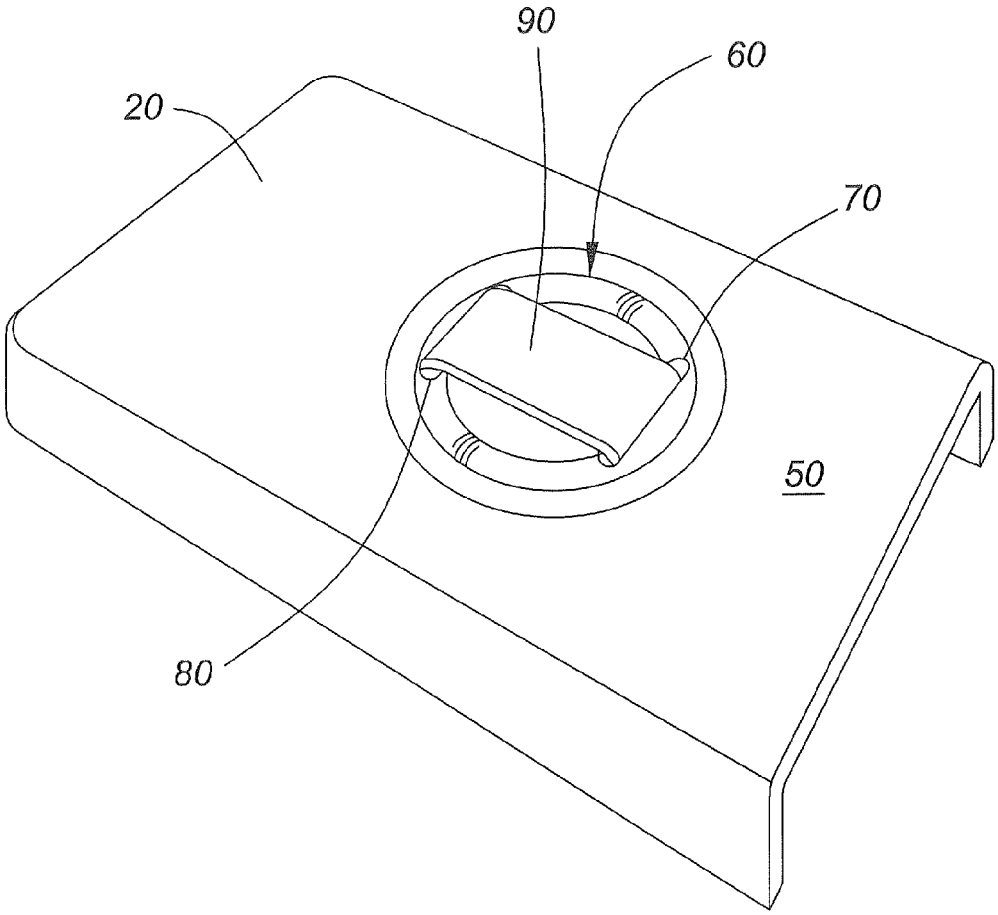
FIG. 1 is a perspective topside view of a gripper provided in a portable electronic device case, with its strap in a retracted position.

In use, the gripper (10) is inserted into the case opening (30) as described above. A phone (190) or computer (200) is inserted into the case inside (40), as appropriate to the case (20) size and function. The strap (90) is pulled out, and the user can insert their finger (210) or hand (220) there through as appropriate, positioning said finger (210) or hand (220) between the strap (90) and the retainer (60). Thereafter, the case (20) can easily be carried and rotated, by keeping the finger (210) or hand (220) in place. The case (20) can be returned to a holster (not shown) or pocket (not shown) by removing said finger (210) or hand (220), and pushing the strap into a retracted flat position (FIG. 1).

A specific embodiment of the present invention has been described to illustrate only, a manner in which this invention is made and used. Implementation of variations and modifications will be apparent to one skilled in this art, and this invention is not limited by the embodiment illustrated. The present invention includes modifications, variations, and equivalents that fall within the spirit and scope of the underlying principles disclosed and claimed herein.

What is claimed is:

1. A gripper for gripping a portable electronic device case, the case defining an opening, the case having an inside and an outside, the gripper comprising:

a retainer to partially pass through the case opening, the retainer defining two opposing slots; and a retractable strap having two flanged ends, each strap flanged end being passed through the retainer slots and communicating with the case inside, the strap flanged ends being shaped to prevent the strap from completely passing through said retainer slots to the case outside when the strap is pulled.

2. The gripper in claim 1 wherein the retainer is rotatable within the case opening.

3. The gripper in claim 1 wherein the retainer is made of plastic.

4. The gripper in claim 1 wherein the strap is made of plastic.

5. The gripper in claim 1 wherein the case opening is circular.

6. The gripper in claim 1 wherein the retainer is circular.

7. The gripper in claim 1 wherein the strap is sized to permit one selected from a group comprising a finger and a hand, to pass there through when the strap is pulled.

8. The gripper in claim 1 wherein the case is sized to hold one selected from a group comprising a phone, a computer, and a computerized tablet.

9. The gripper in claim 1 wherein the case defines a recessed groove on the case inside, circumscribing the case opening.

10. The gripper in claim 9 wherein the retainer nestles in the recessed groove and lies in a plane with the case inside.

11. The gripper in claim 1 wherein the retainer has a circumscribing flange to bias against the case inside to prevent the retainer from completely passing through the case opening to the case outside.

12. The gripper in claim 11 wherein each retainer slot is adjacent the circumscribing flange.

13. The gripper in claim 11 wherein the case defines a recessed groove on the case inside, circumscribing the case opening.

14. The gripper in claim 13 wherein the retainer flange nestles in the recessed groove and lies in a plane with the case inside.

15. The gripper in claim 11 wherein the circumscribing flange defines two opposing breaks therein, to pass the retainer strap there through.

16. The gripper in claim 15 wherein the strap flanged ends are shaped to bias against the circumscribing flange when the strap is pulled.

* * * * *